US008069754B2

(12) United States Patent
Elgin

(10) Patent No.: US 8,069,754 B2
(45) Date of Patent: Dec. 6, 2011

(54) SOCKET WRENCH WITH WASHER GRIPPING ARMS

(76) Inventor: Kenneth Lee Elgin, Glendale, AZ (US)

( * ) Notice: Subject to any disclaimer, the term of this patent is extended or adjusted under 35 U.S.C. 154(b) by 0 days.

(21) Appl. No.: 12/470,967

(22) Filed: May 22, 2009

(65) Prior Publication Data

US 2009/0308210 A1 Dec. 17, 2009

Related U.S. Application Data

(60) Provisional application No. 61/131,867, filed on Jun. 13, 2008.

(51) Int. Cl.
*B25B 23/28* (2006.01)
*B25B 13/06* (2006.01)

(52) U.S. Cl. ..... 81/125; 81/112

(58) Field of Classification Search ..... 81/125, 81/124.1, 13, 44, 451–453, 112–118
See application file for complete search history.

(56) References Cited

U.S. PATENT DOCUMENTS 601,188 A * 3/1898 Webster ..... 81/452
1,441,956 A * 1/1923 Watson ..... 81/452
2,498,324 A * 2/1950 Yourglich et al. ..... 81/125
2,611,289 A * 9/1952 Frank ..... 81/125
2,701,494 A * 2/1955 Johnson ..... 81/125
4,552,039 A * 11/1985 Fisher ..... 81/64
4,744,273 A * 5/1988 Bartok, Jr. ..... 81/125
5,640,889 A * 6/1997 Anderson ..... 81/125
6,557,727 B1 * 5/2003 Robertson ..... 81/124.1
7,246,540 B2 * 7/2007 Rillera ..... 81/13

* cited by examiner

*Primary Examiner* — Hadi Shakeri

(74) *Attorney, Agent, or Firm* — Parsons & Goltry; Robert A. Parsons; Michael W. Goltry

(57) ABSTRACT

A multipurpose socket wrench includes an elongated tubular body with an internal opening extending longitudinally from the distal end and having a hexagonal cross-section. A driver receiving opening extends longitudinally from the proximal end. Elongated holding arms are positioned in longitudinally extending grooves formed in the outer surface of the body. The arms are mounted for limited longitudinal movement between an extended position and a retracted position. An attachment component gripping feature is positioned in the portion of the arms extending beyond the distal end of the body with the arms in the extended position. The arms are further mounted for limited radial movement of the gripping features.

5 Claims, 7 Drawing Sheets

SOCKET WRENCH WITH WASHER GRIPPING ARMS

CROSS-REFERENCE TO RELATED APPLICATIONS

This application claims the benefit of U.S. Provisional Application No. 61/131,867, filed 13 Jun. 2008.

FIELD OF THE INVENTION

This invention generally relates to a socket wrench and more specifically to a socket wrench for use on high power lines and the like.

BACKGROUND OF THE INVENTION

Throughout the electrical industry ½ inch cadmium bolts, nuts and round washers are standard hardware for power plants, substations, transmission lines, switch yards and distribution systems including switching cabinets (live front and dead front), overhead transformers and pad mount transformers. It is not always convenient or efficient to switch out lines so that a worker can attach a component or otherwise bolt a component in place. Some typical hot line tasks that can preferably be performed without switching out the line include installing jumper paddles to dead end bodies, buss work, tee bodies, etc., installing new line jumpers to existing bus work, removing jumpers to isolate switch gear for maintenance and then reinstalling existing or new jumpers on the energized buss, changing out hot bolts and transmission lines, replacing missing bolts, etc.

Generally, when performing hot line work an electrician/lineman uses various tools, including hot sticks, spring extension sticks, ratchet sticks and various other extension sticks for bolting electrical components in place or connecting electrical components together. As is known in the art, hot sticks and the like are an insulated pole, generally epoxy glass or the like, having a connecter at the distal end. The connector may be changeable and may be a socket or a driver end for engaging a socket. The major problem is that the electrician/lineman must maintain a well known distance in order to safely work on the hot lines and the higher the voltage the farther the electrician must be from the work. Thus, for example, it can be very difficult in many instances to balance a bolt or nut in the hot stick, reach the required distance and engage the nut or bolt with an already positioned bolt or nut. Also, in many instances a washer should be positioned on the bolt before the nut is engaged. A great deal of time and frustrated effort can be expended in this task.

It would be highly advantageous, therefore, to remedy the forgoing and other deficiencies inherent in the prior art.

Accordingly, it is an object of the present invention to provide a new and improved multipurpose socket wrench.

SUMMARY OF THE INVENTION

Briefly, to achieve the desired objects of the instant invention in accordance with a preferred embodiment thereof, provided is a multipurpose socket wrench including an elongated tubular body with a distal end and a proximal end. The body includes an internal opening extending longitudinally from the distal and having an attachment component mating cross-section and a driver receiving opening extending longitudinally from the proximal end. A pair of elongated holding arms having a distal end, are each positioned on diametrically opposed sides of the body and extend longitudinally therealong. Each of the pair of elongated holding arms includes an attachment component gripping feature adjacent the distal end. The holding arms are further mounted on the body for limited radial movement of the gripping features from an attachment component gripping orientation to an attachment component release orientation.

The desired objects of the instant invention are further achieved in accordance with a preferred embodiment thereof, including a multipurpose socket wrench having an elongated tubular body with a distal end and a proximal end. The body includes an internal opening extending longitudinally from the distal and having a hexagonal cross-section and a driver receiving opening extending longitudinally from the proximal end. A pair of longitudinally extending grooves is formed in the outer surface of the body in diametrically opposed relationship. A pair of elongated holding arms are positioned, one each in each of the pair of grooves, the holding arms are mounted in the grooves for limited longitudinal movement therealong between an extended position in which a portion of the arms extends beyond the distal end of the body and a retracted position. Each of the pair of elongated holding arms includes an attachment component gripping feature that is positioned in the portion of the arms extending beyond the distal end of the body with the holding arms in the extended position. The holding arms are further mounted for limited radial movement of the gripping features.

BRIEF DESCRIPTION OF THE DRAWINGS

The foregoing and further and more specific objects and advantages of the instant invention will become readily apparent to those skilled in the art from the following detailed description of a preferred embodiment thereof taken in conjunction with the drawings, in which.

DETAILED DESCRIPTION OF A PREFERRED EMBODIMENT

Figure 1:
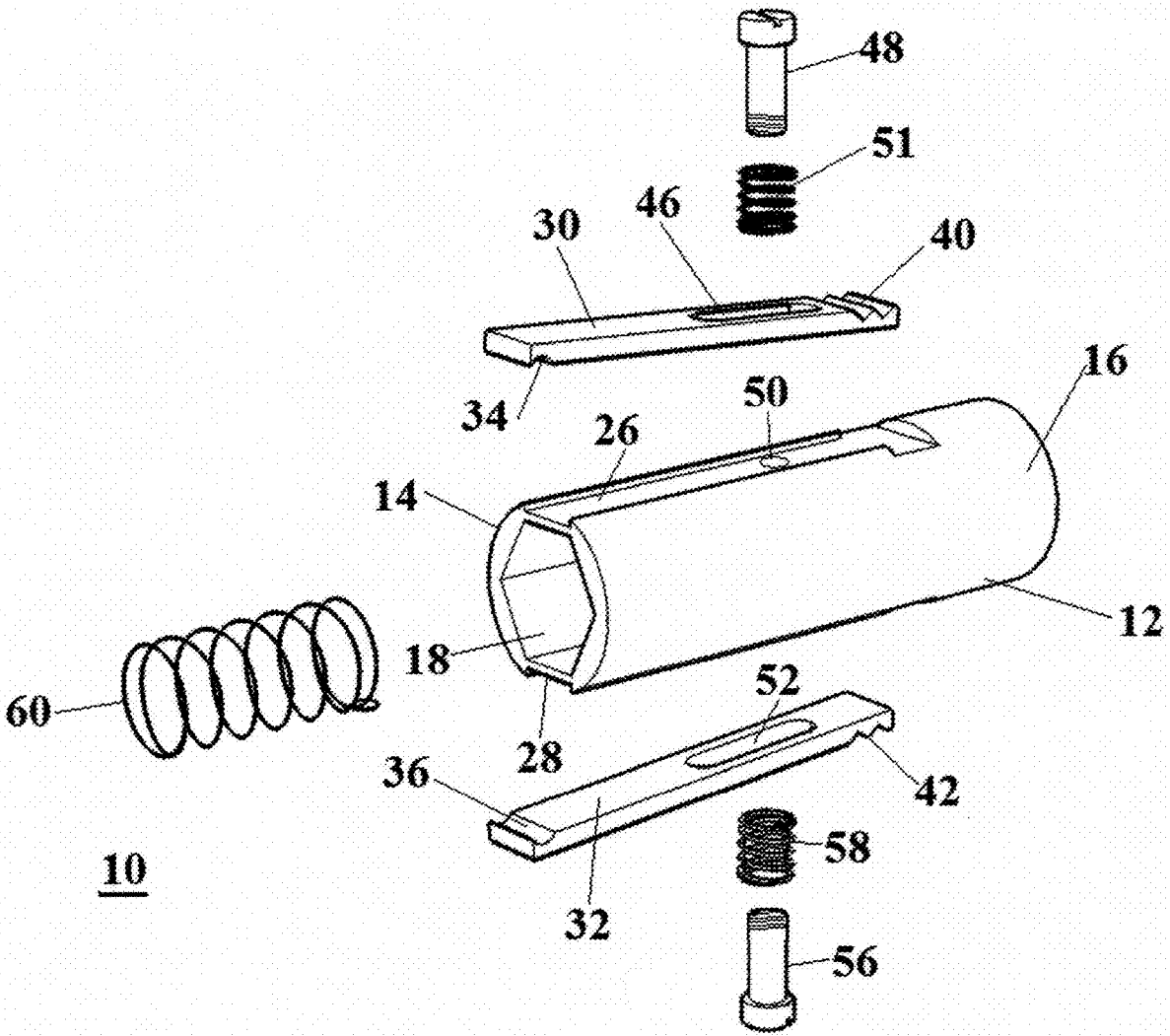
FIG. 1 is an exploded perspective view of a socket wrench with gripping arms for releasably holding any of bolts, nuts and washers, in accordance with the present invention.
Figure 2:
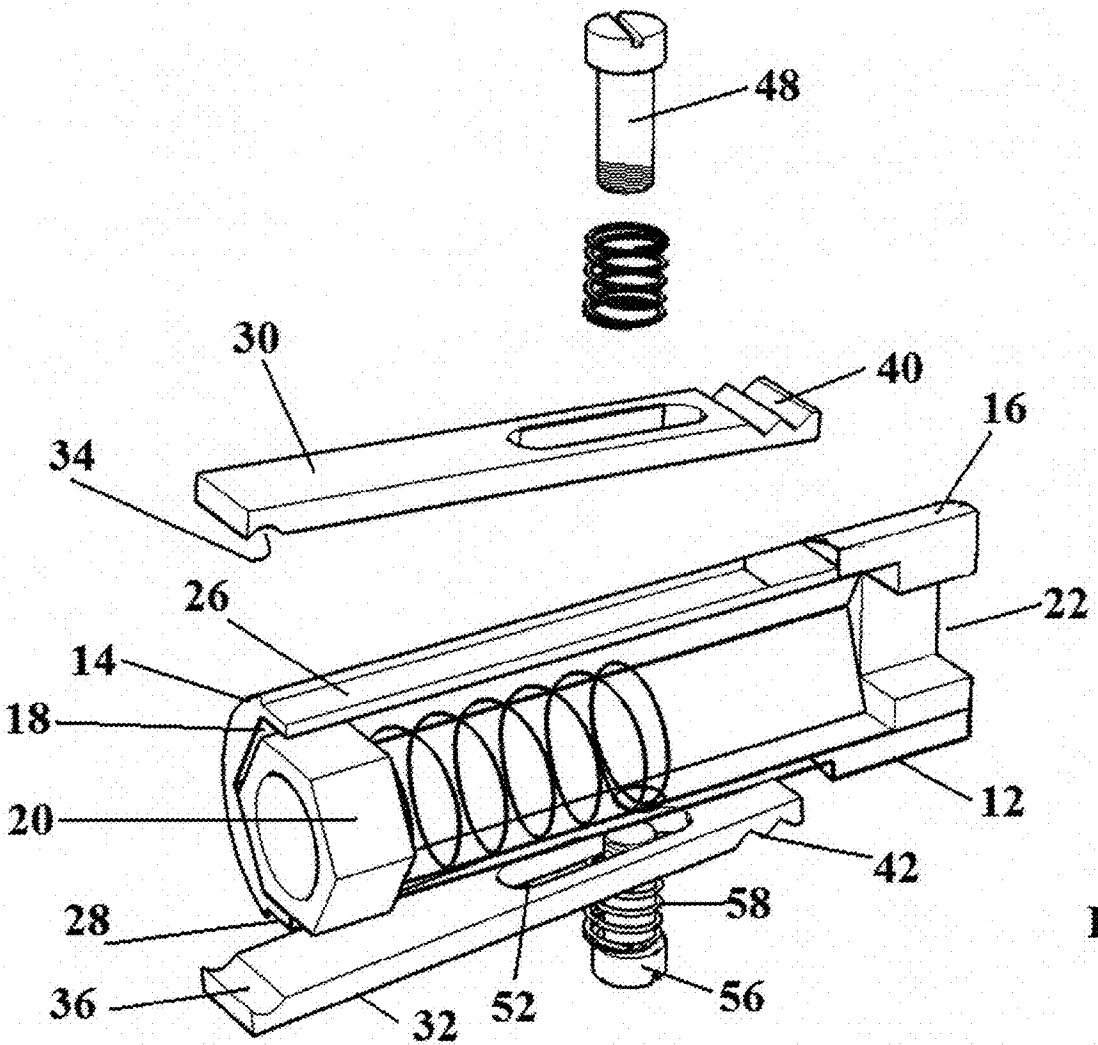
FIG. 2 is a partially assembled perspective view of the socket wrench of FIG. 1 with portions removed to illustrate internal component positions.

Turning now to the drawings, attention is first directed to FIGS. 1 and 2, which illustrates in exploded perspective view a socket wrench 10, in accordance with the present invention. Socket wrench 10 includes an elongated tubular body 12 with a distal end 14 and a proximal end 16. Distal end 14 has a hexagonal opening 18 for receiving therein a hexagonal nut (see nut 20 in FIG. 2), or the hexagonal head of a bolt, etc. For convenience in description nuts, bolts, washers, etc. may be referred to collectively herein as attachment components. Proximal end 16 has an opening 22, with a generally square cross-section, for receiving a driver head. As will be described in more detail presently, the driver head can be situated on the distal end of a wide variety of tools used by electricians/lineman in the field.

An upper trench or groove 26 is formed in the outer surface of body 12 and extends longitudinally from the distal end 14 to a point short of proximal end 16. Similarly, a lower trench or groove 28 is formed in the outer surface of body 12 and extends longitudinally from the distal end 14 to a point short of proximal end 16. Upper groove 26 and lower groove 28 are situated directly across from each other or in direct opposition. Also, upper groove 26 and lower groove 28 have a generally flat rectangular cross-section, i.e. the width is much greater than the depth.

An upper holding arm 30 has a generally flat rectangular cross-section with a transverse width slightly smaller than the transverse width of upper groove 26 and a thickness the same or slightly greater than the depth of upper groove 26. Also the length or longitudinal dimension of upper holding arm 30 is approximately the same as the longitudinal dimension of upper groove 26. Upper holding arm 30 is designed to be mounted in upper groove 26 for limited longitudinal movement therein. Similarly, a lower holding arm 32 is the mirror image of upper holding arm 30 and is designed to be mounted in lower groove 28 for limited longitudinal movement. Each of upper holding arm 30 and lower holding arm 32 has a transverse groove 34 and 36, respectively, formed in the inner surface (i.e. facing the groove 26 and 28, respectively). As will be understood from the more detailed description below, transverse grooves 34 and 36 are provided to hold attachment components and are included as holding features for such attachment components. Also, each of upper holding arm 30 and lower holding arm 32 has a transverse grooved or adjustment area 40 and 42, respectively, formed in the outer surface (i.e. opposite grooves 26 and 28, respectively) adjacent the proximal end. At least adjustment areas 40 and 42 are formed to extend slightly above the grooves 26 and 28 so as to be easily accessible from a remote position.

Upper holding arm 30 has an elongated opening 46 formed therethrough closer to the proximal end or adjacent adjustment area 40. Elongated slot or opening 46 extends longitudinally a short distance along upper holding arm 30. A threaded opening 50 is formed through body 12 in circumferential alignment with slot 46. A shoulder bolt 48 is formed to extend through slot 46 and to be threadedly engaged in threaded opening 50. A compression spring 51 is engaged over the body of shoulder bolt 48 between the head of the bolt and the outer surface of upper holding arm 30 so as to provide a radially inwardly directed bias on upper holding arm 30 with bolt 48 in the assembled position (see FIG. 3). Similarly, lower holding arm 32 has an elongated slot or opening 52 formed therethrough, a mating threaded opening 54 formed through body 12, a shoulder bolt 56 and a compression spring 58 associated therewith.

Figure 3:
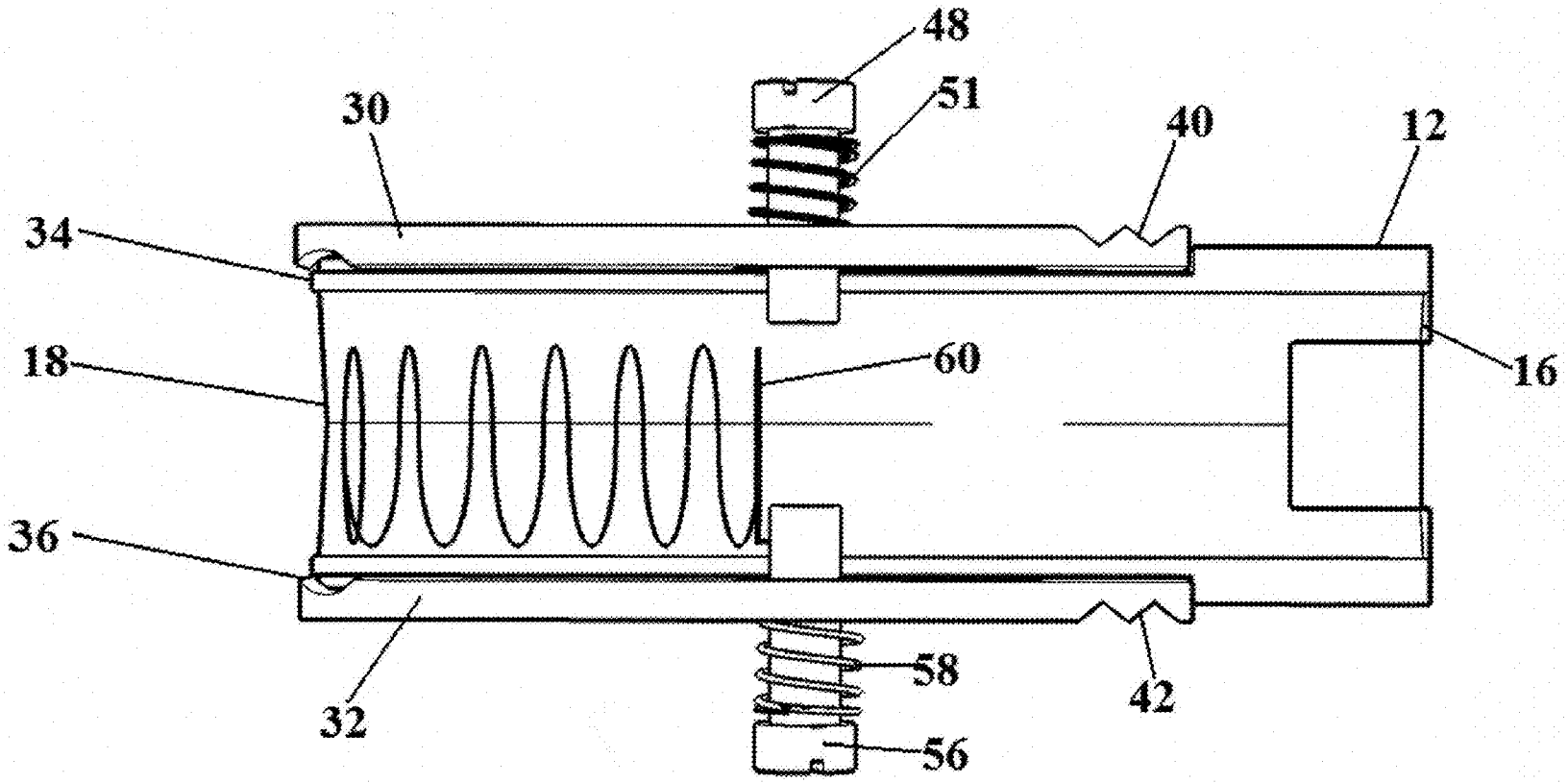
FIG. 3 is a sectional side view, of the fully assembled socket wrench of FIG. 1, illustrating internal components.

Referring additionally to FIG. 3, a sectional view of socket wrench 10 is illustrated in the assembled position. As illustrated, bolt 48 with compression spring 51 engaged thereover extends through slot 46 and is threaded into opening 50 so as to extend radially into the inner opening of body 12. Similarly, bolt 56 with compression spring 58 engaged thereover extends through slot 52 and is threaded into opening 54 so as to extend radially into the inner opening of body 12. Bolts 48 and 56 are positioned approximately along a common diameter of body 12, i.e. they are in opposition. Also, an internal compression spring 60 is positioned within the inner opening in body 12 so that in the extended or uncompressed position (illustrated) one end is positioned at approximately the distal end 18 of body 12 and the opposite end is held in position by one or both of the inner ends of Bolts 48 and 56. In FIG. 3, upper arm 30 and lower arm 32 are illustrated in a retracted or non-holding orientation. It should be noted that in the retracted or non-holding orientation both upper holding arm 30 and lower holding arm 32 are moved longitudinally to the proximal ends of grooves 26 and 28, respectively.

Figure 4:
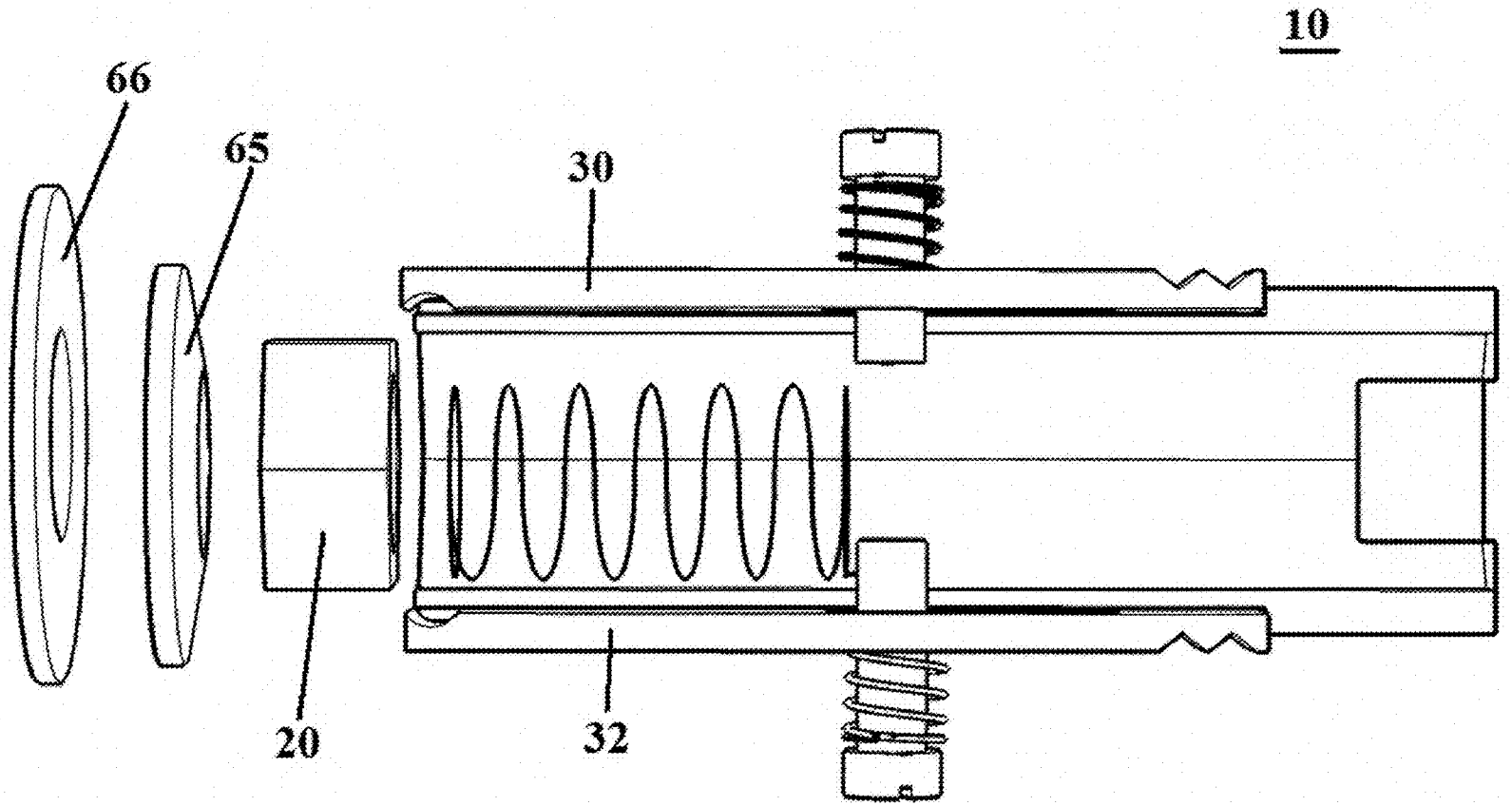
FIG. 4 is a sectional side view of the socket wrench of FIG. 3 illustrating an approximate relative position of a nut and associated washers prior to gripping.
Figure 5:
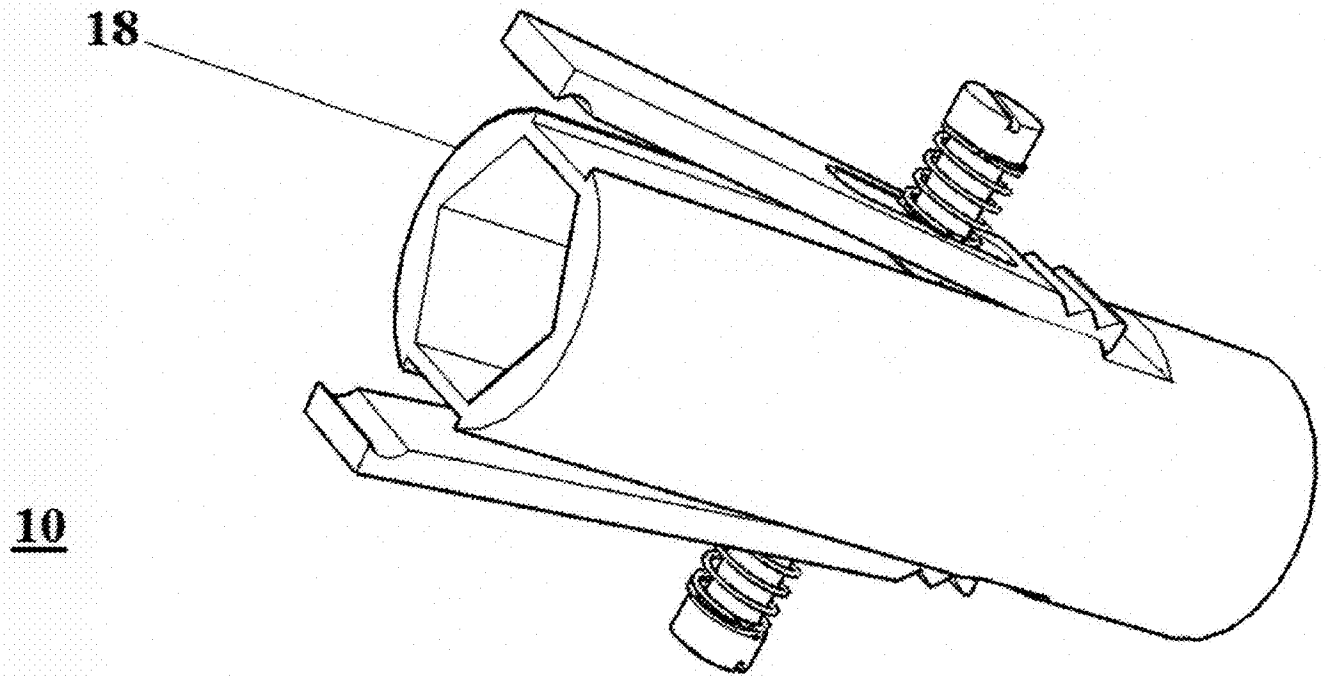
FIG. 5 is a perspective view of the socket wrench of FIG. 1 with the arms in a washer engaging position.
Figure 6:
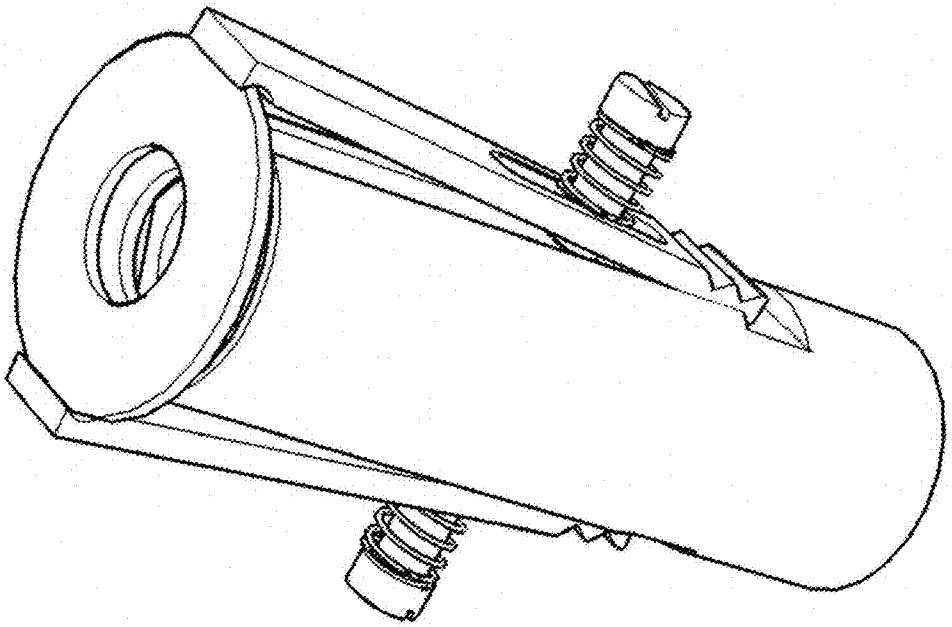
FIG. 6 is a front perspective view of the socket wrench of FIG. 5 with the arms engaging the nut and associated washers prior to installation.

Turning to FIG. 4, a sectional side view of socket wrench 10 illustrates an approximate relative position of nut 20 and associated washers, designated 65 and 66, prior to gripping. In this illustration holding arms 30 and 32 are still in the retracted or non-holding orientation. Referring additionally to FIG. 5, both holding arms 30 and 32 are moved longitudinally in grooves 26 and 28, respectively, into a holding orientation. In the holding orientation, both holding arms 30 and 32 are positioned so that transverse grooves 34 and 36 extend beyond distal end 18 of body 12. In this position nut 20 can be inserted into the longitudinal opening of body 12 with washer 65 in abutting engagement and the outer periphery of washer 66 can be engaged in transverse grooves 34 and 36, as illustrated in FIG. 6. Bolts 48 and 56 are preset in the openings 50 and 54, respectively, they can be made adjustable, to provide adequate holding pressure on washers engaged therein. In this position, internal compression spring 60 is compressed and applies a bias on nut 20 tending to push it out of the opening.

In a typical operation, the electrician/lineman places a nut in the internal opening of the socket. Holding arms 30 and 32 are then slid longitudinally into the holding (extended) orientation. A washer or washers are then inserted between the holding arms, generally one arm at a time. The holding arms are then moved longitudinally toward the proximal end until the washer is flush with the distal end of the socket wrench the washer is then centered so the opening is axially aligned with the nut.

Figure 7:
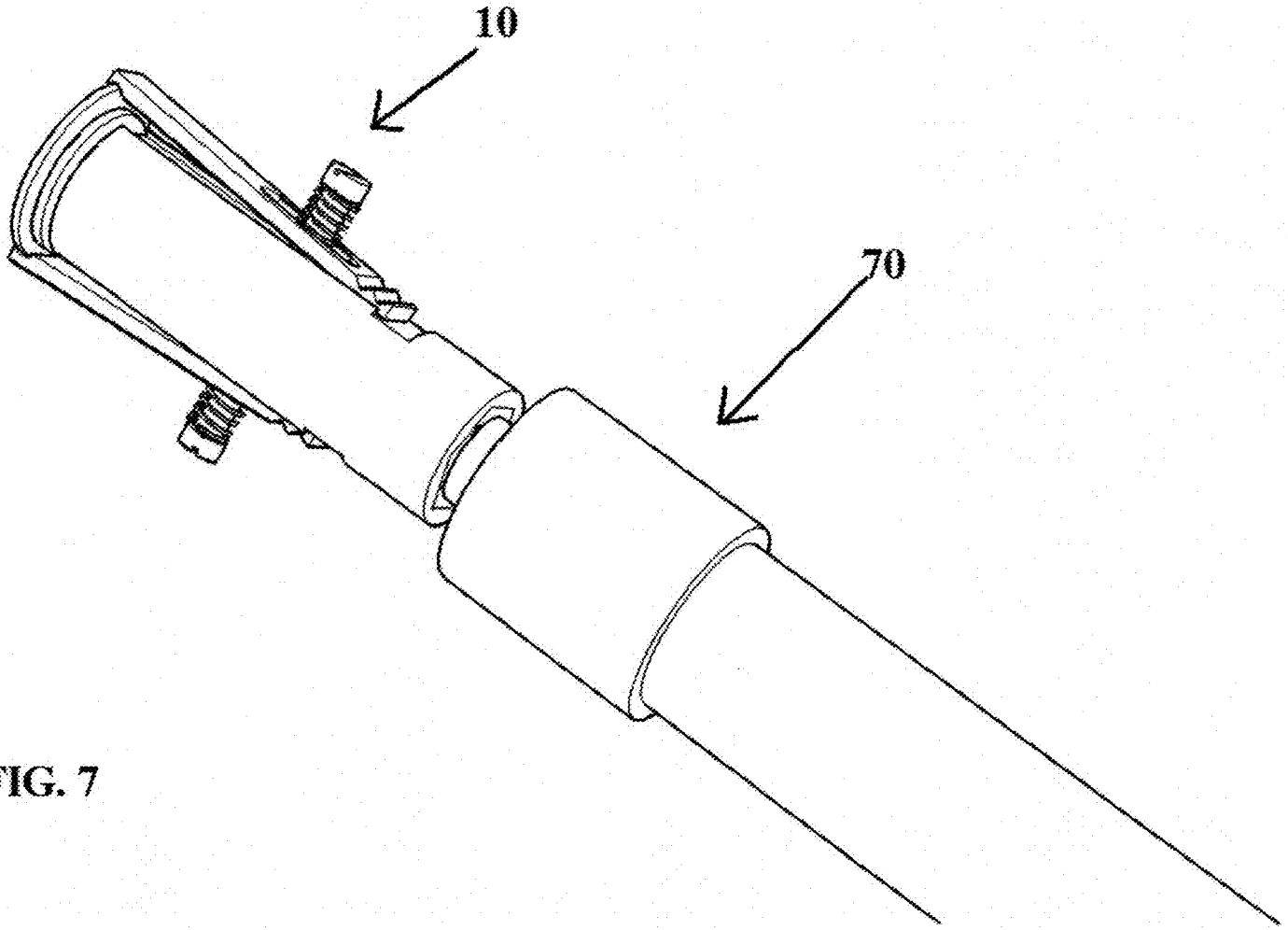
FIG. 7 is a rear perspective view of the socket wrench of FIG. 6 with the arms engaging the nut and associated washers and a hot stick engaged with the proximate end.

With nut 20 and washers 65 and 66 engaged by upper and lower holding arms 30 and 32, socket wrench 10 can be engaged to a driver, designated 70 in FIG. 7, on the distal end of various tools, including hot sticks, spring extension sticks, ratchet sticks and various other extension sticks for bolting electrical components in place or connecting electrical components together when performing hot line work. Nut 20 and washers 65 and 66 are firmly held in position and can conveniently be attached to whatever electrical component the electrician/lineman is working on. It will immediately be understood that bolts can be held in the same fashion and socket wrench 10 can be conveniently and quickly attached to any tool required to perform the work. Once the nut or bolt is in place, socket wrench 10 can be easily disengaged by simply pulling slightly. Internal compression spring 60 provides some bias tending to aid in releasing washers and bolts or nuts from socket wrench 12. The electrician/lineman can then simply bump socket wrench 10 against a solid surface to return arms 30 and 32 to the retracted orientation allowing the operator to continue tightening or even torque with socket wrench 10.

Thus, a new and improved multipurpose socket wrench is disclosed that is capable of holding a washer and a nut or bolt in any of the various tools used by an electrician/lineman in hot line work. Also, while the embodiment illustrated includes features for holding washers, it will be understood that holding features could be included for holding a nut directly or any other attachment component. In some specific applications the movement of the holding arms into a retracted orientation may not be required and, accordingly, they might simply be longitudinally fixed. Further, while the new and improved socket wrench is primarily designed for hot line work, it can also be used for/with electric drills, cordless drills, impact guns, standard ratchets and extensions. While in the embodiment illustrated, the socket wrench is a ½ inch drive, ¾ inch six point deep impact socket designed to hold a nut, Belleville washer, and round washer under spring tension; it can be sized ranging from ½ inch to 1 inch. Further, the inventive socket wrench makes a job very efficient and very safe for personnel.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A multipurpose socket wrench comprising:

an elongated tubular body with a distal end and a proximal end, the body including an internal opening extending longitudinally from the distal and having a hexagonal cross-section, and the body including a driver receiving opening extending longitudinally from the proximal end;

a pair of longitudinally extending grooves formed in the outer surface of the body in diametrically opposed relationship and extending from adjacent the proximal end of the body to the distal end of the body, each of the grooves having a generally rectangular cross section;

a pair of elongated holding arms positioned, one each in each of the pair of grooves, the holding arms being mounted in the grooves for limited longitudinal movement therealong between an extended position in which a portion of the arms extends beyond the distal end of the body and a retracted position;

each of the pair of elongated holding arms including an attachment component gripping feature, the gripping features being positioned in the portion of the arms extending beyond the distal end of the body with the holding arms in the extended position, the holding arms being further mounted for limited radial movement of the gripping features;

each of the holding arms including a longitudinally extending slot therethrough; and a pair of mounting bolts, one each extending through the slot in each holding arm and threadedly engaged in the body, a pair of compression springs associated with each bolt of the pair of bolts and positioned between a bolt head and the associated holding arm so as to bias the associated holding arm radially inwardly, the longitudinally extending slots being positioned to allow the limited longitudinal movement between the extended position and the retracted position.

2. A multipurpose socket wrench as claimed in claim 1 wherein the pair of mounting bolts threadedly engaged in the body are radially adjustable to change the radial bias on the associated holding arm.

3. A multipurpose socket wrench as claimed in claim 1 wherein each of the holding arms further includes an adjustment area formed in the outer surface adjacent the proximal end of the body.

4. A multipurpose socket wrench as claimed in claim 1 wherein the attachment component gripping feature of each of the holding arms includes a transversely extending groove in the inner surface.

5. A multipurpose socket wrench as claimed in claim 1 wherein the driver receiving opening extending longitudinally from the proximal end of the body is formed to be coupled to any one of various tools used by an electrician/lineman in hot line work including hot sticks, spring extension sticks, ratchet sticks and other extension sticks for bolting electrical components in place or connecting electrical components together.

* * * * *